US005424175A

United States Patent [19]

Ueda et al.

[11] Patent Number: 5,424,175

[45] Date of Patent: Jun. 13, 1995

[54] PROCESSING METHOD FOR SILVER HALIDE COLOR LIGHT-SENSITIVE MATERIAL

[75] Inventors: Eiichi Ueda; Hiromitsu Araki; Tohru Kobayashi; Kazuo Kato, all of Tokyo, Japan

[73] Assignee: Konica Corporation, Tokyo, Japan

[21] Appl. No.: 312,449

[22] Filed: Sep. 26, 1994

Related U.S. Application Data

[63] Continuation of Ser. No. 48,143, Apr. 15, 1993, abandoned.

[30] Foreign Application Priority Data

May 1, 1992 [JP] Japan ..... 4-112744

[51] Int. Cl.[6] ..... G03C 1/00; G03C 1/795

[52] U.S. Cl. ..... 430/403; 430/496; 430/501; 430/533

[58] Field of Search ..... 430/403, 496, 501, 533

[56] References Cited

U.S. PATENT DOCUMENTS

| | | | |
|---|---|---|---|
| 5,057,403 | 10/1991 | Kume et al. | 430/501 |
| 5,223,359 | 6/1993 | Shelton et al. | 430/403 |
| 5,225,319 | 7/1993 | Fukazawa et al. | 430/533 |

*Primary Examiner*—Charles L. Bowers, Jr.

*Assistant Examiner*—Mark F. Huff

*Attorney, Agent, or Firm*—Frishauf, Holtz, Goodman & Woodward

[57] ABSTRACT

A method of processing a silver halide color light-sensitive material is disclosed. The material has a silver halide emulsion layer on one side of a photographic support of less than 100 μm thickness and a backing layer on the other side and is processed while being conveyed in a developing machine, wherein the conveying tension in the processing machine is not more than 700 g, and the following formula applies:

$$(30\times D)+(2\times E)-(600\times \mu k)\geqq 3{,}000$$

wherein D is the thickness (μm) of the photographic support; E is the Young modulus of elasticity (kg/mm$^2$) of the photographic support in a wet state; μk is the coefficient of friction between the backing layer and the conveying roller in the processing machine in the wet state.

The method provides continuous efficient processing with good film conveyability, with no folding on sides of the silver halide photographic light-sensitive material during processing using a developing machine.

13 Claims, 1 Drawing Sheet

PROCESSING METHOD FOR SILVER HALIDE COLOR LIGHT-SENSITIVE MATERIAL

This application is a continuation of application Ser. No. 08/048,143, filed Apr. 15, 1993, now abandoned.

BACKGROUND OF THE INVENTION

The present invention relates to a processing method for silver halide color light-sensitive material, more specifically a processing method for silver halide color light-sensitive material allowing efficient photographic processing with no folding while conveying the silver halide color light-sensitive material in the processing machine.

Presently, compact cameras are commonly used by ordinary users. From the viewpoint of portability of such compact cameras, further size reduction is desired. To achieve this, it is essential to reduce the size of the photographic film housing space in the camera.

Since the photographic film is usually housed rolled around a spool in the compact camera, it is necessary to reduce the thickness of the photographic film itself to maintain a given number of frames while achieving such further housing space size reduction in the compact camera. Support thickness is currently about 120 to 125 μm, considerably thicker than the thickness of the light-sensitive layer formed thereon (20 to 30 μm). It is therefore most effective to further reduce the support thickness in order to reduce the thickness of the whole photographic film.

A representative conventional support material is the triacetyl cellulose (also referred to as TAC) film. However, since the TAC film is essentially low in mechanical strength, further reduction in the TAC film thickness results in considerable difficulty in conveying and handling the film in the camera and following processes. It is therefore not advantageous to further reduce the thickness of the TAC film support below that of the currently available support.

Meantime, polyethylene terephthalate, traditionally used in radiographic films and printing plate making films, is excellent in mechanical strength. It is therefore possible to reduce photographic film thickness and hence achieve camera size reduction by using this material as the support.

In processing a large number of photographic films using a developing machine, it is common practice to use an automatic processing machine for motion picture film, wherein the photographic films are tied in a single strip, which is then subjected to a series of photographic processes while being wound at one end and conveyed at a constant speed. The automatic processing machine for motion picture film is characterized in that the film, hung obliquely on a rack on and under which a large number of rollers are arranged, is subjected to developing, drying and other processes while being conveyed in a roll state.

However, it was proven that when developing a thin photographic film described above using the automatic processing machine for motion picture film, there occurs a problem of folding in the perforated portion of the photographic film. Suspected causes of this phenomenon are contact of the photographic film with roller edge as a result of shift to either end during oblique conveying between the rollers at both ends of the rack, and a lack of mechanical strength due to the thinness of the photographic film.

Thus there is a need for a processing method capable of processing a silver halide color light-sensitive material while smoothly and efficiently conveying it in a processing machine with no photographic film folding.

SUMMARY OF THE INVENTION

The object of the present invention is to overcome the above problems and provide a silver halide color light-sensitive material processing method capable of efficiently processing a silver halide color light-sensitive material without damage using a processing machine, wherein film conveying quality is excellent and no folding occurs in either side of the silver halide color light-sensitive material.

In the present invention a silver halide color light-sensitive material having at least one silver halide emulsion layer on one side of a photographic support of less than 100 μm thickness and a backing layer on the other side is automatically processed by being conveyed in a processing machine to meet the following requirements:
the conveying tension in the processing machine is not more than 700 g, and
the following formula applies:

$$(30\times D)+(2\times E)-(600\times \mu k)\geqq 3{,}000$$

wherein D is the thickness (μm) of the photographic support with a value of under 100; E is the Young modulus of elasticity (kg/mm$^2$) of the photographic support in a wet state; μk is the coefficient of friction between the backing layer and the conveying roller in the processing machine in the wet state.

The photographic support thickness is preferably under 90 μm.

DETAILED DISCLOSURE OF THE INVENTION

Figure 1:
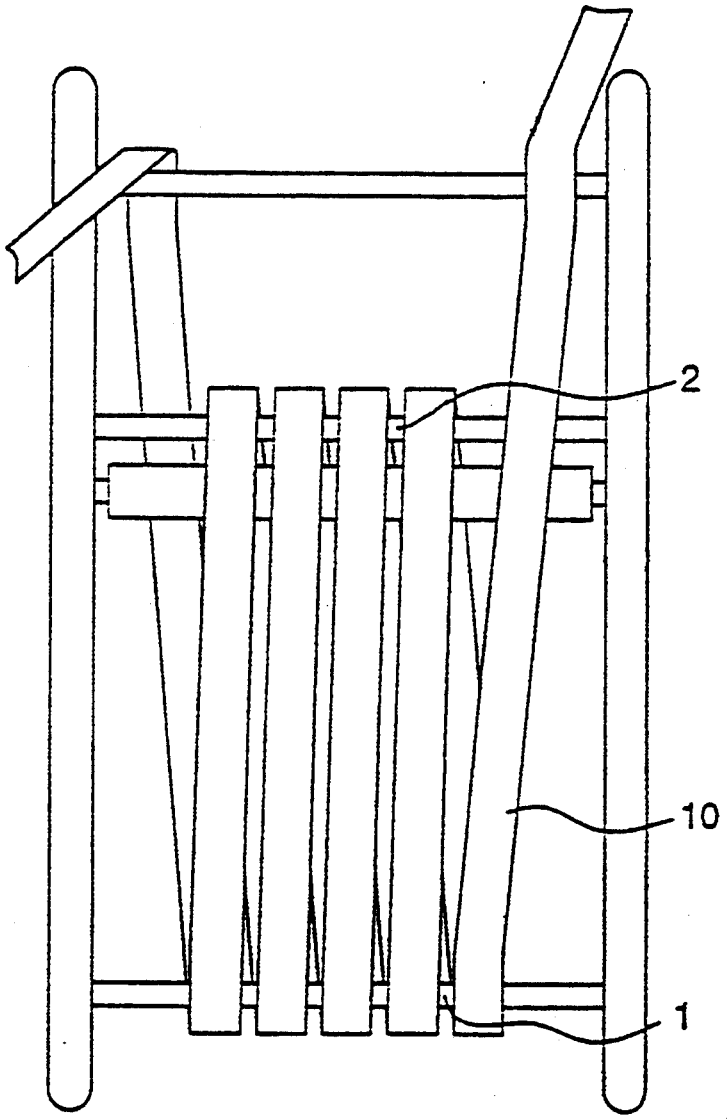
FIG. 1 illustrates a developing rack for an automatic processing machine usable for developing the present invention photographic material.

The present invention is hereinafter described in detail.

The present invention is a method of automatically processing a silver halide color light-sensitive material (A) having a photographic support having a particular thickness under particular conditions (C) using a developing machine (B) having a conveying portion.

(A) Silver halide color light-sensitive material Photographic support

The silver halide color light-sensitive material used in the present invention is not subject to limitation, as long as it has at least one silver halide emulsion layer A-2 on one side of a photographic support A-1 having a thickness of under 100 μm and a backing layer A-3 on the other side. Examples of such light-sensitive materials include various known silver halide color light-sensitive materials.

Photographic support A-1 described above is not subject to limitation, as long as its thickness is under 100 μm. Examples of such photographic supports include various photographic supports comprising one or more layers of cellulose acetate film, polyester or another resin formed by various methods. The use of such a photographic support, having a thickness of under 100 μm, makes it possible to obtain a silver halide color light-sensitive material for the present invention which is thinner than conventional ones. The present method therefore makes it possible to effectively process a thin silver halide color light-sensitive material for a compact camera. From the viewpoint of further camera size reduction, the photographic support thickness is preferably under 90 μm.

However, a thin silver halide color light-sensitive material tends to have unmanageable curls. Processing such a light-sensitive material with unmanageable curls using a processing machine results in an increased tendency for the silver halide light-sensitive material to be folded or jammed in the conveying portion of the processing machine. For thin silver halide color light-sensitive materials which are free of such a tendency and which permit smooth and efficient conveying and processing in the processing machine, the photographic support may be a copolymer polyester whose copolymer component is an aromatic dicarboxylic acid having a metal sulfonate group, preferably a copolymer polyester containing an aromatic dicarboxylic acid having a metal sulfonate group and a small amount of diethylene glycol as copolymer components and an aromatic dibasic acid and glycol as other major components.

Such aromatic dibasic acids include terephthalic acid, isophthalic acid and 2,6-naphthalenedicarboxylic acid. Such glycols include propylene glycol, butanediol, neopentyl glycol, 1,4-cyclohexanedimethanol and p-xylylene glycol. The preferred aromatic dibasic acid is terephthalic acid.

Examples of aromatic dicarboxylic acids having a metal sulfonate group include 5-sodiumsulfoisophthalic acid, 2-sodiumsulfoisophthalic acid, 4-sodiumsulfoisophthalic acid, 4-sodiumsulfo-2,6-naphthalenedicarboxylic acid, ester-forming derivatives and compounds resulting from replacement of sodium in these compounds with other metals such as potassium and lithium.

With respect to the copolymer polyester having an aromatic dicarboxylic acid having a metal sulfonate group, the amount of aromatic dicarboxylic acid having a metal sulfonate group as detected upon hydrolysis of the copolymer polyester is preferably 2 to 7 mol % of the total ester linkage. If the content of the aromatic dicarboxylic acid containing a metal sulfonate group is under 2 mol %, photographic film curling is sometimes unremovable; if it exceeds 7 mol %, the photographic support may be of poor heat endurance.

The copolymer polyester for the present invention contains diethylene glycol in a ratio of not more than 5 mol %, preferably not more than 4 mol %, and still more preferably not more than 3 mol % of the total ester linkage. If the diethylene glycol content exceeds 5 mol %, the heat endurance of the photographic support tends to be deteriorated considerably. Although the reason for this deterioration remains unknown, it is speculated that this is because the copolymer polyester fails to be crystallized sufficiently in the thermal fixing process for the photographic support copolymer polyester film.

This amount of diethylene glycol is as detected upon hydrolysis of the copolymer polyester. By the presence of this diethylene glycol in a ratio of not more than 5 mol % of the total ester linkage, the photographic support of the present invention offers excellent film curling recovery, and the photographic support does not lose its surface flatness even when various aqueous coating solutions are coated on the surface thereof, followed by heating at high temperature.

The copolymer polyester for the present invention may contain as a copolymer component polyalkylene glycol and/or an aliphatic dicarboxylic acid having 4 to 20 carbon atoms, as long as it has as copolymer components an aromatic dicarboxylic acid having a metal sulfonate group and diethylene glycol and the object of the present invention is not interfered with.

Such polyalkyl glycols include polyethylene glycol and polytetramethylene glycol, with preference given to polyethylene glycol. Although the molecular weight is not subject to limitation, it is normally 300 to 20,000, preferably 600 to 20,000, and more preferably 1,000 to 5,000.

Aliphatic dicarboxylic acids having 4 to 20 carbon atoms include succinic acid, adipic acid and sebacic acid, with preference given to adipic acid.

When the copolymer polyester of the present invention, containing an aromatic dicarboxylic acid having a metal sulfonate group and diethylene glycol, contains an aliphatic dicarboxylic acid as a monomer unit, the amount of aliphatic dicarboxylic acid detected upon hydrolyzing this copolymer polyester is normally 3 to 25 mol % of the total ester linkage. Provided that the copolymer component aliphatic dicarboxylic acid is contained in the copolymer polyester within the above content range, photographic film curling can easily be avoided and the photographic support will have practically acceptable heat endurance.

The copolymer polyester used in the present invention may contain other kinds of copolymer components, as long as the object of the present invention is not interfered with.

Although the copolymer polyester containing an aromatic dicarboxylic acid having a metal sulfonate group as a copolymer component is not subject to limitation as to production method, it is preferably produced by a method wherein a dicarboxylic acid component and a glycol component are subjected to ester exchange and subsequent polymerization condensation at high temperature and under reduced pressure. In this case, the copolymer component aromatic dicarboxylic acid having a metal sulfonate group or polyethylene glycol may be added at the time of ester exchange reaction, or after ester exchange reaction, before polymerization condensation.

Catalysts which can be used for this ester exchange include acetates, fatty acid salts, carbonates and other salts of metals such as manganese, calcium, zinc and cobalt, with preference given to hydrates of manganese acetate and calcium acetate, more preferably a mixture thereof.

As long as the reaction is not interfered with or the polymer is not colored upon the above ester exchange and/or polymerization condensation, hydroxides, aliphatic carboxylic acid metal salts, quaternary ammonium, etc. may be effectively added, with preference given to sodium hydroxide, sodium acetate and tetraethylhydroxyammonium, more preferably sodium acetate. The amount of addition of these additives is preferably $1\times10^{-2}$ to $20\times10^{-2}$ mol, relative to the total ester linkage.

The copolymer polyester used in the present invention may contain phosphoric acid, phosphorous acid, esters thereof, and inorganic grains such as those of silica, kaolin, calcium carbonate, calcium phosphate and titanium dioxide, which are added as appropriate at the time of polymerization, or may contain such inorganic grains which are added as appropriate after polymerization.

Also, this copolymer polyester may contain dyes, UV absorbents, antioxidants and other additives added as appropriate at the time of ester exchange reaction, at the time of polymerization or after polymerization.

The photographic support for the present invention preferably contains a particular copolymer polyester and antioxidant.

This antioxidant is not subject to limitation as to its kind. Example antioxidants include hindered phenol compounds, allylamine compounds, phosphite compounds and thioester antioxidants, with preference given to hindered phenol compounds.

For excellent photographic performance with no increase in copolymer polyester turbidity, the antioxidant content in the photographic support is normally 0.01 to 2% by weight, preferably 0.1 to 0.5% by weight of the copolymer polyester. Antioxidants may be used singly or in combination.

The photographic support for the present invention also preferably contains a dye to prevent the light piping phenomenon (edge fog) occurring upon entry of incident light via the edge in the photographic support coated with photographic emulsion layers. Although the dye incorporated for this purpose is not subject to limitation as to its kind, an excellently heat endurable dye is preferred from the viewpoint of film preparation. Examples of such dyes include anthraquinone dyes. For photographic support color tone, it is preferable to dye it gray as in ordinary light-sensitive materials, and these dyes may be used singly or in combination. Such dyes include SUMIPLAST (a series of dyes of different colors) of Sumitomo Chemical Co., Ltd., DIARESIN (a series of dyes of different colors) of Mitsubishi Chemical Industries, Ltd. and MACROLEX (a series of dyes of different colors) of Bayer Company, which may be used singly or in combination as appropriate.

The photographic support for the present invention can, for example, be produced as follows: First, the above-described copolymer polyester or a copolymer polyester composition comprising said copolymer polyester and an antioxidant added as necessary or at least one kind selected from the group comprising sodium acetate, sodium hydroxide and tetraethylhydroxyammonium, is thoroughly dried, after which it is made molten and extruded in a sheet form through an extruder, filter, nozzle, etc. being kept in the temperature range from 260° to 320° C., cooled and solidified on a rotating cooling drum, to yield an unelongated film. This unelongated film is then biaxially (longitudinally and laterally) elongated and then thermally fixed to yield the desired photographic support.

Although film elongating conditions cannot generally be specified, since they vary depending on the copolymer composition of the copolymer polyester, the elongation rate ranges from 2.5 to 6.0 times over the temperature range from the copolymer polyester glass transition temperature (Tg) to Tg+100° C. for the longitudinal direction, and ranges from 2.5to 4.0 times over the temperature range from Tg+5° C. to Tg+50° C. for the lateral direction. The biaxially elongated film thus obtained is usually thermally fixed at 150° to 240° C. and then cooled. In this case, longitudinal and/or lateral relaxation may be performed as necessary.

The photographic support for the present invention may be a monolayer film or sheet formed as described above, or may be of a multiple layered structure wherein a film or sheet formed as described above and another film or sheet of another material are laminated by co-extrusion or lamination.

Silver halide emulsion layer

The silver halide emulsion layer (A-2) described above is exemplified by a layer formed by simultaneously or sequentially coating a silver halide emulsion containing a silver halide such as silver chloride, silver chlorobromide, silver chloroiodobromide, pure silver bromide or silver iodobromide and, added as necessary, other components such as binders, sensitizing dyes, plasticizers, antistatic agents, surfactants and hardeners in optionally chosen ratios, directly or indirectly on one or both faces of the photographic support, by various methods.

Between the silver halide emulsion layer and the photographic support there may be provided non-light-sensitive hydrophilic colloidal layers such as intermediate layers, protective layers, anti-halation layers and backing layers.

The above-mentioned backing layer A-3 is not subject to limitation, whether it is formed with a hydrophobic solvent such as diacetyl cellulose and other substances or with a hydrophilic binder such as gelatin and other substances. However, from the viewpoint of friction reduction in a wet state, it is preferable to form the backing layer with a hydrophilic binder and other substances.

The backing layer may be formed by various methods, as long as it is formed by coating a backing layer coating solution containing limed gelatin, acid-treated gelatin, alkali-treated gelatin, gelatin hydrolyzate or enzyme lysate or other gelatin derivatives, and hydrophilic colloid, matting agent, lubricant, surfactant, hardener, dye, thickening agent, polymer latex and other known compounds on the support's face opposite to the face having the silver halide emulsion layer formed thereon, to form a single or a plurality of layers.

The thickness of the backing layer is normally 0.1 to 15 μm, preferably 0.5 to 10 μm. The backing layer may be configured with two or more layers.

In the case of a backing layer formed with a hydrophilic binder, it is desirable for its thickness to be not more than 15 μm, since photographic film emulsion layer back curling is not too severe upon drying.

(B) Processing machine

Any processing machine can be used for the present invention, as long as it has a winding conveying portion for winding a silver halide color light-sensitive material with rollers and is capable of developing the silver halide color light-sensitive material. Known automatic processing machines are usable.

Such automatic processing machines include the automatic processing machine for motion picture film, which has various processing baths and drying chambers, each of which is equipped with a developing rack as illustrated in FIG. 1. In processing a photographic film using the automatic processing machine for motion picture film, photographic film 10 is conveyed in alternative oblique contact with upper roller 2 and lower roller 1 in the rack. The angle formed by the line from the center of one lower roller and that of the upper roller to which the photographic film is conveyed therefrom is normally 2° to 10° preferably 2.5° to 6.5° to ensure a reasonable processing machine size and freedom of folding even when the requirements of the invention are met.

The winding conveying portion described above is not subject to limitation, as long as it functions to convey a silver halide color light-sensitive material via rollers. Such winding conveying portions include those comprising various elements. Although the silver halide color light-sensitive material may be conveyed manually or electrically, the conveying portion preferably has an electrical drive capable of winding the silver halide color light-sensitive material at constant output in large amounts for a long time.

The roller is not subject to limitation, as long as it is capable of conveying a silver halide color light-sensitive material and it meets the requirement of the following formula as to the coefficient of friction between the roller and the silver halide color light-sensitive material being conveyed. Usable rollers include those formed with various materials such as rubber and plastics by various methods. Rollers of rubber or plastic material are preferred.

Although the surface condition of the roller is not subject to limitation, whether smooth, grooved or ridged, as long as smooth conveying is not interfered with, it is preferable for the roller to have 1 to 2 mm diameter spikes in the case of rubber rollers, or to have 1 to 5 mm high or deep ridges or grooves in the case of flexible plastic rollers. A pair of roller may be used in combination. In the present invention, rubber rollers with spikes on the surface are particularly preferred.

Although roller conveying of the silver halide color light-sensitive material is not subject to limitation, it is a preferred mode to continuously convey a large amount of silver halide color light-sensitive material and finally wind it.

Although the processing machine used for the present invention may be of automatic or manual operation, it is preferable to use an automatic processing machine capable of processing a large amount of silver halide color light-sensitive material at a time with no uneven processing. Of the automatic processing machines, the automatic processing machine for motion picture film is preferably used for the present invention, which is capable of continuously performing a series of processes, such as developing with a known developer and drying, while obliquely conveying the silver halide color light-sensitive material.

Conveying conditions (C)

The requirements for the silver halide color light-sensitive material relating to the present invention in the processing machine are as follows:

The following formula applies:

$$(30\times D)+(2\times E)-(600\times \mu k)\geqq 3{,}000$$

wherein D is the thickness ($\mu$m) of the photographic support ($D<100$); E is the Young modulus of elasticity (kg/mm$^2$) of the photographic support in a wet state; $\mu$k is the coefficient of friction between the backing layer of the silver halide color light-sensitive material and the roller in the processing machine in the wet state, and conveying tension in the processing machine is not more than 700 g.

Unless the above formula is met and unless the conveying tension is not greater than 700 g, folding can occur in the silver halide color light-sensitive material during its conveyance in the automatic processing machine and efficient conveying is hampered in some cases.

The photographic support thickness D (mm) in the silver halide color light-sensitive material described above is as measured before the subbing layer is formed.

The thickness of the photographic support can be measured using a known instrument for ordinary thickness determination such as a micrometer on a sample after moisture conditioning at 23° C. and 55% RH for 24 hours.

The Young modulus of elasticity E (kg/mm$^2$) of the photographic support of the silver halide color light-sensitive material in a wet state is defined to be obtained from a stress-strain curve using an ordinary tensile tester.

The value for Young's modulus E can be obtained in the longitudinal direction, using a commercially available tester, such as Tensilon (produced by Toyo Baldwin K. K.), in accordance with JIS-K7113, with a rectangular piece of 10 mm width and 100 mm length of the photographic film in a wet state at a pulling speed of 100 mm/min.

The above-mentioned wet state is defined for the photographic film sample to be wet upon removal from the stabilizing bath following processing as with ordinary negative films. The sample's Young's modulus is determined by immediate measurement of this wet film using the above apparatus.

The coefficient of friction ($\mu$k) between the backing layer of the silver halide color light-sensitive material in the wet state and the roller in the processing machine is defined to be obtained when the silver halide color light-sensitive material remains completely dried just after winding removal from the developer in the processing machine and before the drying process.

The above coefficient of friction can be determined by, for example, cutting out a 10 mm$^2$ piece of rubber from the roller of the automatic processing machine for motion picture film (NCV-60, produced by Noritsu Koki) and attaching it to a 10 mm$\times$10 mm stainless steel rubbing sheet, applying a load of 100 g on this rubbing sheet, and sliding the rubbing sheet over the silver halide photographic light-sensitive material sample at a speed of 10 m/min and under conditions of 23° C. and 55% RH. In this determination, the silver halide photographic light-sensitive material sample is taken out from the stabilizing bath for the final process and then squeezed with a rubber blade to remove the surface water, and while in a semi-dried condition, it is immediately run for determination of coefficient of friction by the above method.

In the present invention, the value obtained from a combination of photographic support thickness D, Young modulus of elasticity E and coefficient of friction $\mu$k for the left side of the above formula should be not less than 3,000. If this value is under 3,000, it can be increased to above 3,000 by appropriately changing the above photographic support thickness D, Young modulus of elasticity E or coefficient of friction $\mu$k.

To have a value of over 3,000 for the left side, it is necessary to use as thick a silver halide color light-sensitive material as possible while keeping the photographic support thickness preferably below 90 $\mu$m, or to increase the Young modulus of elasticity of the silver halide color light-sensitive material in the wet state, while minimizing the above coefficient of friction $\mu$k.

Specifically, the methods for obtaining a value of over 3,000 for the left side include the method wherein a roller made of a material having as low a coefficient of friction as possible is used in the processing machine, the method wherein the coefficient of friction is reduced by the addition of a matting agent, lubricant etc. to the backing layer of the silver halide color light-sensitive material, the method wherein the thickness of the photographic support is increased, and the method wherein the Young modulus of elasticity of the photographic support is increased by changing the resin composition of the copolymer polyester in the photographic support or changing the elongating conditions. These methods may be used as appropriate to meet the requirements of the above formula. The value is preferably not more than 5,000 and more preferably 3,000 to 4,000.

The conveying tension in the processing machine is defined to be obtained at the portion where the film is conveyed from the stabilizing bath to the drying portion in the processing machine, and can be obtained by reading the indication on a spring scale which is suspended on a roller between the final roller in the stabilizing bath and the first roller in the drying portion while the photographic film is being pulled.

In the present invention, the conveying tension is normally not more than 700 g, and can be reduced below 700 g by adjusting various elements of the conveying system of the processing machine. In the case of the above developing rack, the conveying tension can be reduced below 700 g by finely adjusting the gap between the driving roller and upper roller in each rack. The tension is preferably not less than 250 g.

EXAMPLES

The present invention is hereinafter described in more detail by means of the following examples.

Example 1

On one side of an 85 μm thick polyethylene terephthalate film as a photographic support, subbing layers B-3 and B-5 having the following compositions were formed in this order, and subbing layer B-7 having the following composition was formed on the opposite side. Then, emulsion layers of the following compositions were formed on subbing layer 5, and backing layer A of the following compositions were formed on subbing layer 7 in this order, to yield a silver halide photographic light-sensitive material having the properties shown in Table 1.

The amounts in the following subbing layers, backing layer and emulsion layers are per $m^2$.

| | |
|---|---|
| Subbing layer B-3 | |
| Copolymer of 30% by weight butyl acrylate, 20% by weight t-butyl acrylate, 25% by weight styrene and 25% by weight 2-hydroxyethyl acrylate | 0.8 g |
| Subbing layer B-4 | |
| Copolymer of 40% by weight butyl acrylate, 25% by weight styrene and 40% by weight glycidyl acrylate | 0.8 g |
| Compound UL-1 | 2.2 mg |
| Hexamethylene-1,6-bis(ethyleneurea) | 1.8 mg |
| Subbing layer B-5 | |
| Gelatin | 1.0 g |
| Compound UL-1 | 20 mg |
| Compound UL-2 | 20 mg |
| Compound UL-3 | 10 mg |
| Silica grains (average grain size 3 μm) | 10 mg |
| Subbing layer B-7 | |
| Compound UL-5 | 0.1 g |

The structures of the compounds used (UL-1 through 7) will be given later.

| | |
|---|---|
| Backing layer A | |
| Layer 1 | |
| Alumina sol (aluminum oxide AS-100, produced by Nissan Chemical industries, Ltd.) | 0.8 g |
| Layer 2 (outermost layer) | |
| Diacetyl cellulose | 0.1 g |
| Stearic acid | 0.01 g |
| Fine silica grains (average grain size 0.2 μm) | 0.05 g |
| Emulsion layers | |
| Layer 1: Anti-halation layer HC | |
| Black colloidal silver | 0.15 g |
| UV absorbent UV-1 | 0.20 g |
| Compound CC-1 | 0.02 g |
| High boiling solvent Oil-1 | 0.20 g |
| High boiling solvent Oil-2 | 0.20 g |
| Gelatin | 1.6 g |
| Layer 2: First intermediate layer IL-1 | |
| Gelatin | 1.3 g |
| Layer 3: Low speed red-sensitive emulsion layer RL | |
| Silver iodobromide emulsion (average grain size 0.3 μm, average silver iodide content 2.0 mol %) | 0.4 g |
| Silver iodobromide emulsion (average grain size 0.4 μm, average silver iodide content 8.0 mol %) | 0.3 g |
| Sensitizing dye S-1 | $3.2 \times 10^{-4}$ (mol/mol silver) |
| Sensitizing dye S-2 | $3.2 \times 10^{-4}$ (mol/mol silver) |
| Sensitizing dye S-3 | $0.2 \times 10^{-4}$ (mol/mol silver) |
| Cyan coupler C-1 | 0.50 g |
| Cyan coupler C-2 | 0.13 g |
| Colored cyan coupler CC-1 | 0.07 g |
| DIR compound D-1 | 0.006 g |
| DIR compound D-2 | 0.01 g |
| High boiling solvent Oil-1 | 0.55 g |
| Gelatin | 1.0 g |
| Layer 4: High speed red-sensitive emulsion layer RH | |
| Silver iodobromide emulsion (average grain size 0.7 μm, average silver iodide content 7.5 mol %) | 0.9 g |
| Sensitizing dye S-1 | $1.7 \times 10^{-4}$ (mol/mol silver) |
| Sensitizing dye S-2 | $1.6 \times 10^{-4}$ (mol/mol silver) |
| Sensitizing dye S-3 | $0.1 \times 10^{-4}$ (mol/mol silver) |
| Cyan coupler C-2 | 0.23 g |
| Colored cyan coupler CC-1 | 0.03 g |
| DIR compound D-2 | 0.02 g |
| High boiling solvent Oil-1 | 0.25 g |
| Gelatin | 1.0 g |
| Layer 5: Second intermediate layer IL-2 | |
| Gelatin | 0.8 g |
| Layer 6: Low speed green-sensitive emulsion layer GL | |
| Silver iodobromide emulsion (average grain size 0.4 μm, average silver iodide content 8.0 mol %) | 0.6 g |
| Silver iodobromide emulsion (average grain size 0.3 μm, average silver iodide content 2.0 mol %) | 0.2 g |
| Sensitizing dye S-4 | $6.7 \times 10^{-4}$ (mol/mol silver) |
| Sensitizing dye S-5 | $0.8 \times 10^{-4}$ (mol/mol silver) |
| Magenta coupler M-1 | 0.17 g |
| Magenta coupler M-2 | 0.43 g |
| Colored magenta coupler CM-1 | 0.10 g |
| DIR compound D-3 | 0.02 g |
| High boiling solvent Oil-2 | 0.7 g |
| Gelatin | 1.0 g |
| Layer 7: High speed green-sensitive emulsion layer GH | |
| Silver iodobromide emulsion (average grain size 0.7 μm, average silver iodide | 0.9 g |

-continued

| | |
|---|---|
| content 7.5 mol %) | |
| Sensitizing dye S-6 | $1.1 \times 10^{-4}$ (mol/mol silver) |
| Sensitizing dye S-7 | $2.0 \times 10^{-4}$ (mol/mol silver) |
| Sensitizing dye S-8 | $0.3 \times 10^{-4}$ (mol/mol silver) |
| Magenta coupler M-1 | 0.30 g |
| Magenta coupler M-2 | 0.13 g |
| Colored magenta coupler CM-1 | 0.04 g |
| DIR compound D-3 | 0.004 g |
| High boiling solvent Oil-2 | 0.35 g |
| Gelatin | 1.0 g |
| Layer 8: Yellow filter layer YC | |
| Yellow colloidal silver | 0.1 g |
| Additive HS-1 | 0.07 g |
| Additive HS-2 | 0.07 g |
| Additive SC-1 | 0.12 g |
| High boiling solvent Oil-2 | 0.15 g |
| Gelatin | 1.0 g |
| Layer 9: Low speed blue-sensitive emulsion layer BL | |
| Silver iodobromide emulsion (average grain size 0.3 μm, average silver iodide content 2.0 mol %) | 0.25 g |
| Silver iodobromide emulsion (average grain size 0.4 μm, average silver iodide content 8.0 mol %) | 0.25 g |
| Sensitizing dye S-9 | $5.8 \times 10^{-4}$ (mol/mol silver) |
| Yellow coupler Y-1 | 0.6 g |
| Yellow coupler Y-2 | 0.32 g |
| DIR compound D-1 | 0.003 g |
| DIR compound D-2 | 0.006 g |
| High boiling solvent Oil-2 | 0.18 g |
| Gelatin | 1.3 g |
| Layer 10: High speed blue-sensitive emulsion layer BH | |
| Silver iodobromide emulsion (average grain size 0.8 μm, average silver iodide content 8.5 mol %) | 0.5 g |
| Sensitizing dye S-10 | $3 \times 10^{-4}$ (mol/mol silver) |
| Sensitizing dye S-11 | $1.2 \times 10^{-4}$ (mol/mol silver) |
| Yellow coupler Y-1 | 0.18 g |
| Yellow coupler Y-2 | 0.10 g |
| High boiling solvent Oil-2 | 0.05 g |
| Gelatin | 2.0 g |
| Layer 11: First protective layer Pro-1 | |
| Silver iodobromide (average grain size 0.08 μm) | 0.3 g |
| UV absorbent UV-1 | 0.07 g |
| UV absorbent UV-2 | 0.10 g |
| Additive HS-1 | 0.2 g |
| Additive HS-2 | 0.1 g |
| High boiling solvent Oil-1 | 0.07 g |
| High boiling solvent Oil-3 | 0.07 g |
| Gelatin | 0.8 g |
| Layer 12: Second protective layer Pro-2 | |
| Compound A | 0.04 g |
| Compound B | 0.004 g |
| Polymethyl methacrylate (average grain size 3 μm) | 0.02 g |
| Methyl methacrylate:ethyl methacrylate:methacrylic acid = 3:3:4 (weight ratio) copolymer (average grain size 3 μm) | 0.13 g |
| Gelatin | 0.7 g |

Preparation of silver iodobromide emulsion

The silver iodobromide emulsion used in layer 10 was prepared as follows:

Using monodispersed silver iodobromide grains having an average grain size of 0.33 μm and a silver iodide content of 2 mol % as seed crystal, a silver iodobromide emulsion was prepared by the double jet method.

To solution G-1 of the following composition being kept at a temperature of 70° C., a pAg of 7.8 and a pH of 7.0, the seed emulsion, in an amount equivalent to 0.34 mol, was added, while stirring the solution vigorously.

Formation of inner high iodine phase (core phase)

Then, solutions H-1 and S-1, having the following respective compositions, were added at increasing flow rates (the final flow rate was 3.6 times the initial flow rate) over a period of 86 minutes, while maintaining a flow rate ratio of 1:1.

Formation of outer low iodine phase (shell phase)

Subsequently, while maintaining a pAg of 10.1 and a pH of 6.0, solutions H-2 and S-2 were added at a flow rate ratio of 1:1 at increasing flow rates (the final flow rate was 5.2 times the initial flow rate) over a period of 65 minutes.

During grain formation, pAg and pH were regulated using an aqueous solution of potassium bromide and a 56% aqueous solution of acetic acid. Grain formation was followed by washing by a conventional flocculation method, after which the grains were re-dispersed in gelatin and the dispersion was adjusted to a pH of 5.8 and a pAg of 8.06 at 40° C.

The emulsion obtained was a monodispersed emulsion comprising octahedral silver iodobromide grains having an average grain size of 0.80 μm, a distribution width of 12.4% and a silver iodide content of 8.5 mol %.

| | |
|---|---|
| Solution G-1 | |
| Ossein gelatin | 100.0 g |
| 10% by weight methanol solution of the following compound I | 25.0 ml |
| 28% aqueous ammonia | 440.0 ml |
| 56% aqueous solution of acetic acid | 660.0 ml |
| Water was added to 5000.0 ml. | |
| *Compound I: Sodium polypropyleneoxy-polyethyleneoxy disuccinate | |
| Solution H-1 | |
| Ossein gelatin | 82.4 g |
| Potassium bromide | 151.6 g |
| Potassium iodide | 90.6 g |
| Water was added to 1030.5 ml. | |
| Solution S-1 | |
| Silver nitrate | 309.2 g |
| 28% aqueous ammonia | Equal molar amount |
| Water was added to 1030.5 ml | |
| Solution H-2 | |
| Ossein gelatin | 302.1 g |
| Potassium bromide | 770.0 g |
| Potassium iodide | 33.2 g |
| Water was added to 3776.8 ml | |
| Solution S-2 | |
| Silver nitrate | 1133.0 g |
| 28% aqueous ammonia | Equal molar amount |
| Water was added to 3776.8 ml | |

The silver iodobromide emulsions used in the emulsion layers other than layer 10 were prepared in the same manner as above, which had different average grain sizes and silver iodide contents, wherein average grain size of seed crystal, temperature, pAg, pH, flow rate, addition time and halide composition were varied.

All emulsions obtained were core/shell type monodispersed emulsions having a distribution width of not higher than 20%. Each emulsion was subjected to optimum chemical ripening with sodium thiosulfate, chloroauric acid and ammonium thiocyanate, and sensitizing dyes, 4-hydroxy-6-methyl-1,3,3a,7-tetrazaindene and 1-phenyl-5-mercaptotetrazole were added.

In addition to these additives, the above-mentioned light-sensitive material contained compounds Su-1 and Su-2, a thickener, hardeners H-1 and H-2, a stabilizer ST-1, antifogging agents AF-1 and AF-2 (weight-average molecular weights of 10,000 and 1,100,000, respectively), dyes AI-1 and AI-2 and a compound DI-1 (9.4 mg/m$^2$).

Evaluation

The silver halide photographic light-sensitive material thus obtained was processed at various conveying tensions as shown in Table 2, using an automatic processing machine for motion picture film (NCV-60, produced by Noritsu Koki), and examined for folding in terms of the parameters shown below. The results are given in Table 2.

Photographic support thickness

Photographic film samples, kept standing at 23° C. and 55% RH for 24 hours for moisture conditioning, were tested using a micrometer.

Young modulus of elasticity

Using Tensilon (produced by Toyo Baldwin K. K.), in accordance with JIS-K7113, the Young modulus of elasticity of the photographic film, in the form of a 10 mm wide and 100 mm long rectangular piece in a wet state, was measured in the longitudinal direction at a pulling speed of 100 mm/min.

The photographic film sample was tested while still wet just after it was taken out of the stabilizing bath after the processes described below.

Film processing

TABLE 1

| Processing procedure | Processing time | Processing temperature (°C.) |
|---|---|---|
| Color developing | 3 minutes 15 seconds | 38 |
| Bleaching 1 | 2 minutes 10 seconds | 38 |
| Bleaching 2 | 4 minutes 20 seconds | 38 |
| Fixing 1 | 2 minutes 10 seconds | 38 |
| Fixing 2 | 2 minutes 10 seconds | 38 |
| Washing 1 | 1 minute 05 seconds | 20 |
| Washing 2 | 2 minutes 10 seconds | 20 |
| Stabilizing | 1 minute 05 seconds | 38 |
| Drying | 4 minutes 40 seconds | 60 |

The color developer, bleacher, fixer, stabilizer and replenishers therefor were prepared as follows:

| Color developer | |
|---|---|
| Water | 800 ml |
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxylethyl)aniline | 4.5 g |
| sulfate | 4.5 g |
| Diethylenetriaminepentaacetic acid | 3.0 g |
| Potassium hydroxide | 1.2 g |

Water was added to 1 l, and potassium hydroxide or 20% sulfuric acid was added to obtain a pH of 10.06.

| Color developer replenisher | |
|---|---|
| Water | 800 ml |
| Potassium carbonate | 35 g |
| Sodium hydrogen carbonate | 3 g |
| Potassium sulfite | 5 g |
| Sodium bromide | 0.4 g |

-continued

| Color developer replenisher | |
|---|---|
| Hydroxylamine sulfate | 3.1 g |
| 4-amino-3-methyl-N-ethyl-N-(β-hydroxylethyl)aniline sulfate | 6.3 g |
| Potassium hydroxide | 2 g |
| Diethylenetriaminepentaacetic acid | 3.0 g |

Water was added to 1 l, and potassium hydroxide or 20% sulfuric acid was added to obtain a pH of 10.18.

| Bleacher | |
|---|---|
| Water | 700 ml |
| Ammonium iron (III) 1,3-diaminopropanetetraacetate | 125 g |
| Ethylenediaminetetraacetic acid | 2 g |
| Sodium nitrate | 40 g |
| Ammonium bromide | 150 g |
| Glacial acetic acid | 40 g |

Water was added to 1 l, and aqueous ammonia or glacial acetic acid was added to obtain a pH of 4.4.

| Bleacher replenisher | |
|---|---|
| Water | 700 ml |
| Ammonium iron (III) 1,3-diaminopropanetetraacetate | 175 g |
| Ethylenediaminetetraacetic acid | 2 g |
| Sodium nitrate | 50 g |
| Ammonium bromide | 200 g |
| Glacial acetic acid | 56 g |

Water was added to 1 l, and aqueous ammonia or glacial acetic acid was added to obtain a pH of 4.0.

| Fixer | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

After aqueous ammonia or glacial acetic acid was added to obtain a pH of 6.2, water was added to 1 l.

| Fixer replenisher | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |

After aqueous ammonia or glacial acetic acid was used to obtain a pH of 6.5, water was added to 1 l.

| Stabilizer and stabilizer replenisher | |
|---|---|
| Water | 900 ml |
| Compound represented by the following formula 2 | 2.0 g |
| Dimethylolurea | 0.5 g |
| Hexamethylenetetramine | 0.2 g |
| 1,2-benzisothiazolin-3-one | 0.1 g |
| Siloxane L-77, produced by UCC | 0.1 g |

Water was added to 1 l, and aqueous ammonia or 50% sulfuric acid was added to obtain a pH of 8.5.

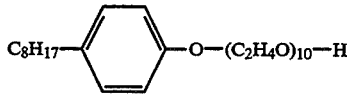

Coefficient of friction

Determined by cutting out a 10 $mm^2$ piece of rubber from the roller of the automatic processing machine for motion picture film (NCV-60, produced by Noritsu Koki) and attaching it to a 10 mm × 10 mm stainless steel rubbing sheet, applying a load of 100 g on this rubbing sheet, and sliding the rubbing sheet over the silver halide photographic light-sensitive material sample at a speed of 10 m/min and under conditions of 23° C. and 55% RH.

In this determination, the silver halide photographic light-sensitive material sample was taken out from the stabilizing bath for the final process and then squeezed with a rubber blade to remove the surface water, and while in a semi-dried condition, it was immediately run for determination of coefficient of friction.

Conveying tension

A roller, on which a spring scale was suspended, was placed between the final roller in the stabilizing bath and the first roller in the drying portion in the automatic processing machine for motion picture film (NCV-60, Noritsu Koki), and the photographic film was pulled, and the load on the spring scale was read.

Folding

The obtained silver halide photographic light-sensitive material was cut into 35 mm × 117 cm slips. Five of these slips were tied and processed using an automatic processing machine for motion picture film (NCV-60, Noritsu Koki).

The silver halide photographic light-sensitive material was evaluated for folding near the center of the drying portion of the automatic processing machine for motion picture, using the criteria shown below. The length shows a total length of folded portion in each film sample of 117 cm.

A: No folding, 0 cm.

B: Almost no folding, less than 2 cm.

C: Slight folding seen very locally, 2–10 cm.

D: Folding seen locally, 10–30 cm.

E: Folding seen over the entire length, over 30 cm.

B and higher levels are acceptable for practical use.

Example 2

A silver halide photographic light-sensitive material was prepared in the same manner as in Example 1 except that the 85 μm thick polyethylene terephthalate film was replaced with a 75 μm thick polyethylene naphthalate film as a photographic support. The silver halide photographic light-sensitive material obtained was evaluated in the same manner as in Example 1. The results are given in Table 2.

Example 3

After subbing layer B-8 of the following composition was formed on both sides of a 85 μm thick triacetyl cellulose film, as a photographic support, backing layer B of the following composition was formed on one side, and the same emulsion layers as in Example 1 were formed on the other side in the same manner, to yield a silver halide photographic light-sensitive material. The obtained silver halide photographic light-sensitive material was evaluated in the same manner as in Example 1. The results are given in Table 2.

| | |
|---|---|
| Subbing layer B-8 | |
| Styrene-maleic anhydride copolymer | 0.01 g |
| Backing layer B | |
| Layer 1 | |
| Gelatin | 4.5 mg |
| Sodium-di-(2-ethylhexyl)-sulfosuccinate | 1.0 mg |
| Sodium tripolyphosphate | 76 mg |
| Citric acid | 16 mg |
| Carboxyalkyldextran sulfate | 49 mg |
| Vinyl sulfone hardener | 30 mg |
| Layer 2 (outermost layer) | |
| Gelatin | 1.5 g |
| Polymer beads (average grain size 3 μm, polymethyl methacrylate) | 24 mg |
| Vinyl sulfone hardener | 45 mg |
| Mixture of compounds SB-1 and SB-2 | 30 mg |
| Compound SB-1 | 100 mg |

Example 4

A copolymer polyester of 75 μm thickness was obtained by a polymerization reaction of dimethyl terephthalate (96 mol %) and 5-sodiumsulfo-di-(β hydroxyethyl)isophthalate (4 mol %) as acid components and ethylene glycol (99.5 mol %) and polyethylene glycol (0.5 mol %, molecular weight 3,000) as alcohol components. On one side of this photographic support, the above subbing layers B-3 and B-5 were formed in this order. On the opposite face, the following subbing layer B-4 was formed to have the following composition, and the above subbing layer B-5 was formed thereon. Then, the above emulsion layers were formed on subbing layer B-5, and the above backing layer B was formed on subbing layer B-7, to yield a silver halide photographic light-sensitive material. The silver halide photographic light-sensitive material obtained was evaluated in the same manner as in Example 1. The results are given in Table 2.

Example 5

A silver halide photographic light-sensitive material was prepared in the same manner as in Example 4 except that the 75 μm thick copolymer polyester was replaced with a 75 μm thick polyethylene terephthalate film as a photographic support. The silver halide photographic light-sensitive material obtained was evaluated in the same manner as in Example 1. The results are given in Table 2.

Example 6

A silver halide photographic light-sensitive material was prepared in the same manner as in Example 4 except that the 75 μm thick copolymer polyester was replaced with a 65 μm thick polyethylene naphthalate film as a photographic support. The silver halide photographic light-sensitive material obtained was evaluated in the same manner as in Example 1. The results are given in Table 2.

Examples 7 through 12

Silver halide photographic light-sensitive materials prepared in the same manner as in Examples 1 through 6 were evaluated in the same manner as in Examples 1 through 6 except that the conveying tension in sample evaluation for folding was changed from 500 g to 650 g. The results are given in Table 2.

Example 13

A sample was prepared in the same manner as in Example 1 except that a 95 μm thick copolymer polyester was used, and evaluated under a conveying tension of 650 g.

Example 14

A silver halide photographic light-sensitive material was prepared with a 98 μm thick triacetyl cellulose film, having backing layer A on one face and subbing layer B-8 on the opposite face and emulsion layers formed thereon. The light-sensitive material obtained was evaluated at a conveying tension of 650 g.

Comparative Example 1

A silver halide photographic light-sensitive material was prepared in the same manner as in Example 1 except that the 85 μm thick polyethylene terephthalate film was replaced with an 85 μm thick triacetyl cellulose film as a photographic support and that the above backing layer A was formed directly on the above photographic support without the above subbing layer B-7. The silver halide photographic light-sensitive material obtained was evaluated in the same manner as in Example 1. The results are given in Table 3.

Comparative Example 2

A silver halide photographic light-sensitive material was prepared in the same manner as in Example 4 except that the thickness of the copolymer polyester used as a photographic support was changed from 75 μm to 85 μm. The silver halide photographic light-sensitive material obtained was evaluated in the same manner as in Example 1. The results are given in Table 3.

Comparative Examples 3 through 8

Silver halide photographic light-sensitive materials were prepared in the same manner as in Examples 1 through 6 except that the thickness of the photographic support was changed to 75 μm, 65 μm, 75 μm, 65 μm, 55 μm and 50 μm, respectively. The silver halide photographic light-sensitive materials obtained were evaluated in the same manner as in Example 1.
The results are given in Table 3.

Comparative Example 9

A silver halide photographic light-sensitive material was prepared in the same manner as in Example 1 except that the 85 μm thick polyethylene terephthalate film was replaced with an 85 μm thick copolymer polyester as a photographic support. The silver halide photographic light-sensitive material obtained was evaluated in the same manner as in Example 1. The results are given in Table 3.

Comparative Example 10

A silver halide photographic light-sensitive material was prepared in the same manner as in Example 2 except that the 85 μm thick polyethylene naphthalate film was replaced with an 85 μm thick polyethylene terephthalate film as a photographic support. The silver halide photographic light-sensitive material obtained was evaluated in the same manner as in Example 1. The results are given in Table 3.

Comparative Examples 11 through 13

Silver halide photographic light-sensitive materials prepared in the same manner as in Comparative Examples 4 through 6 were evaluated in the same manner except that the conveying tension in sample evaluation for folding was changed from 500 g to 650 g. The results are given in Table 3.

Comparative Example 14

A silver halide photographic light-sensitive material was prepared in the same manner as in Example 5 except that the thickness of the photographic support was changed from 75 μm to 65 μm. The silver halide photographic light-sensitive material obtained was evaluated in the same manner as in Example 1.
The results are given in Table 3.

Comparative Examples 15 through 18 and 20 through 23

Silver halide photographic light-sensitive materials prepared in the same manner as in Comparative Examples 1, 2 and 8 and Examples 1 and 3 through 6 were evaluated in the same manner as in Example 1 except that the conveying tension in sample evaluation for folding was changed from 500 g to 750 g. The results are given in Table 3.

Comparative Example 19

A silver halide photographic light-sensitive material was prepared in the same manner as in Example 2 except that the thickness of the photographic support was changed from 75 μm to 85 μm. The silver halide photographic light-sensitive material obtained was evaluated in the same manner as in Example 1. The results are given in Table 3.

The structures of the compounds used to form silver halide photographic light-sensitive materials relating to the present invention are as follows:

UL-1

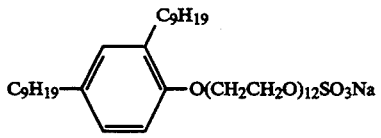

UL-2

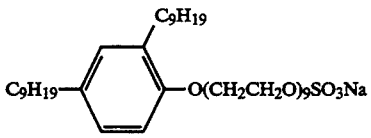

C-1

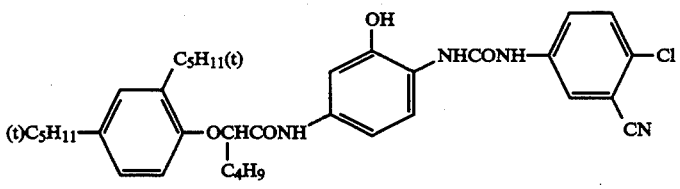

-continued
C-2
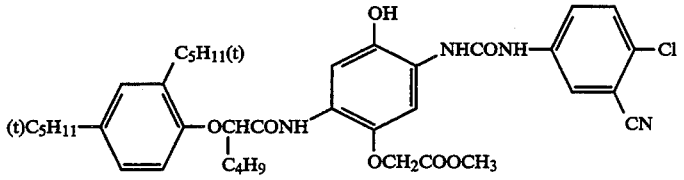
M-1
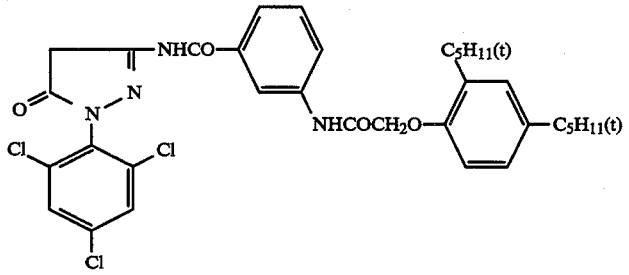
M-2
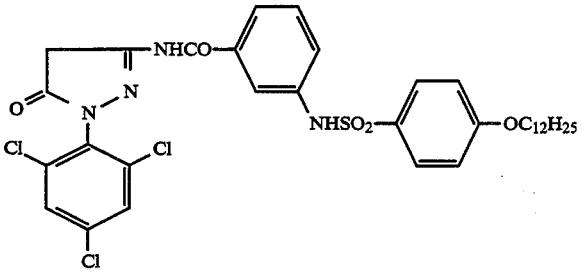
Y-1
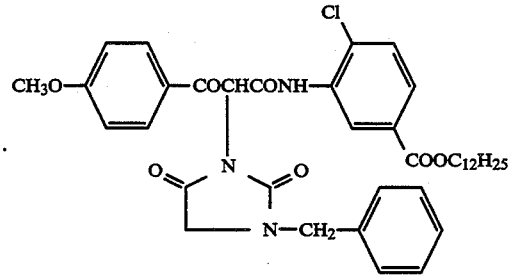
Y-2
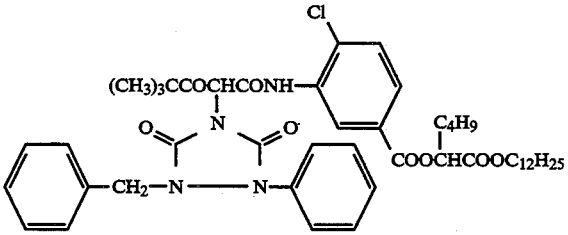
CC-1
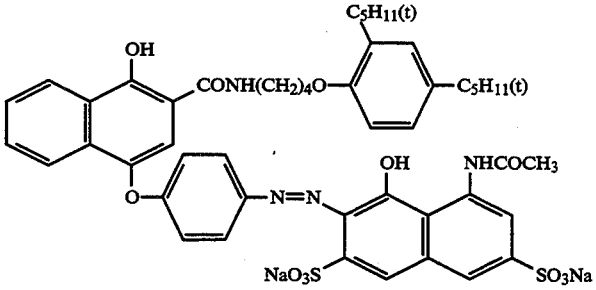

-continued
CM-1
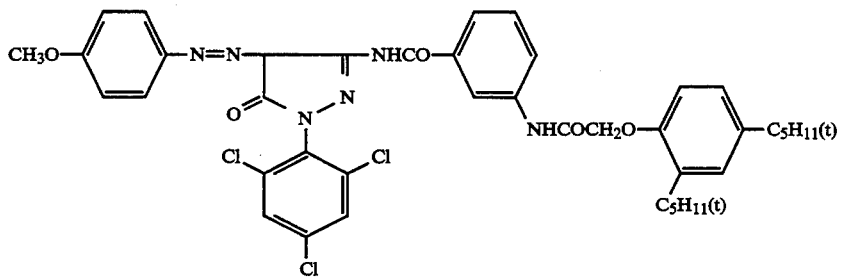
D-1
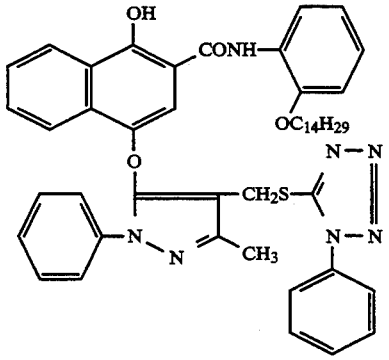
D-2
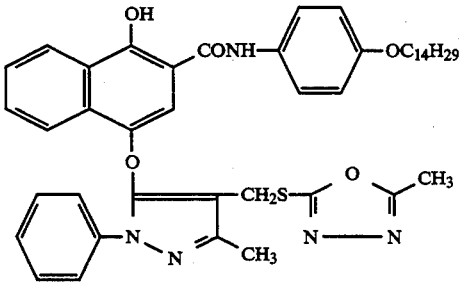
D-3
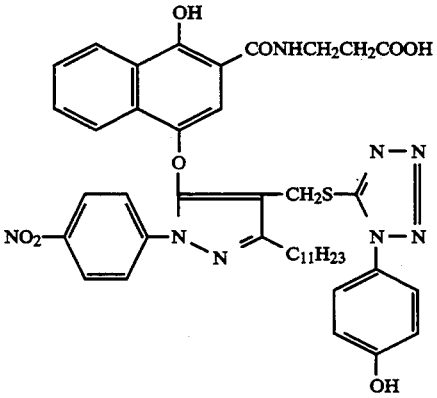
UV-1
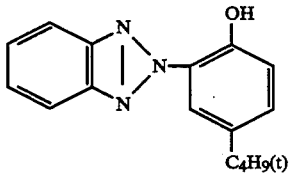
UV-2
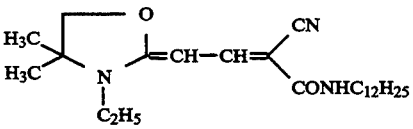
S-1
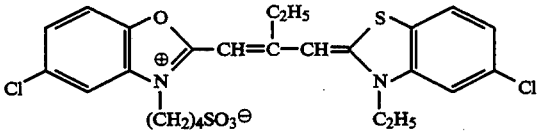
S-2
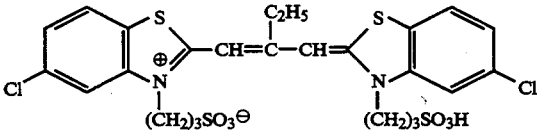
S-3
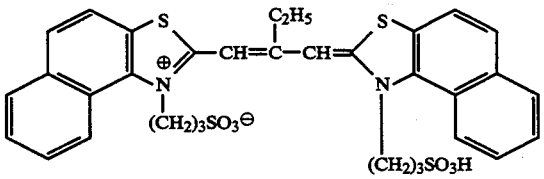
S-4
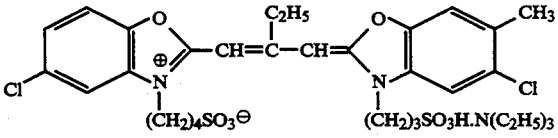

-continued
S-5
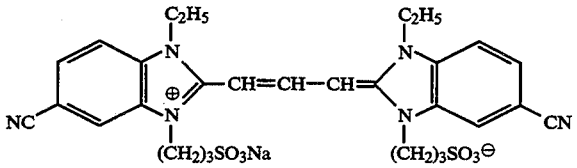
S-6
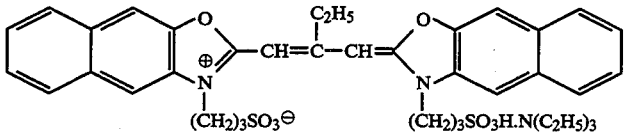
S-7
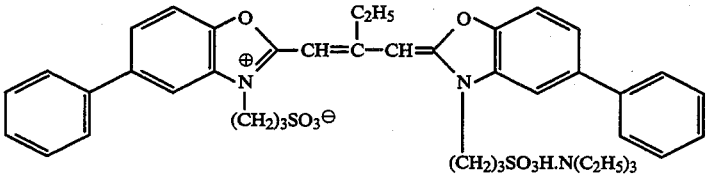
S-8
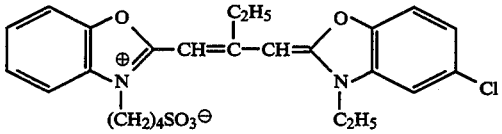
S-9
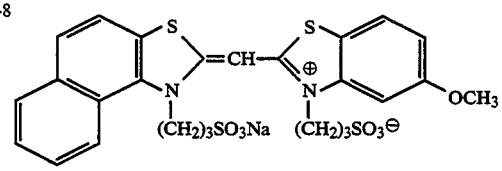
S-10
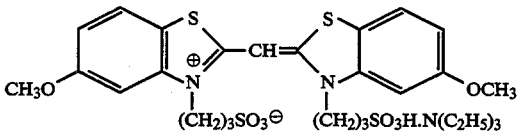
S-11
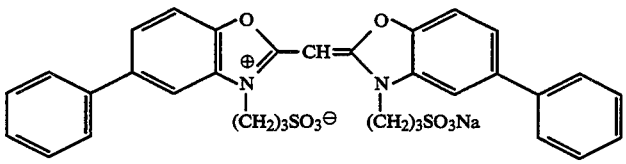
HS-1
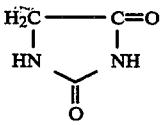
HS-2
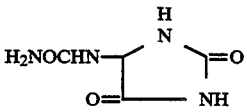
SC-1
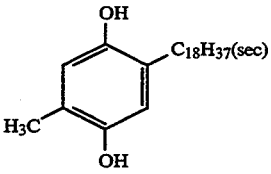
and
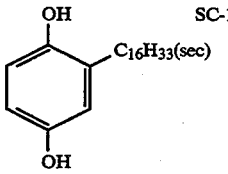
(mixture of 2:3)
Oil-1
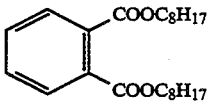
Oil-2
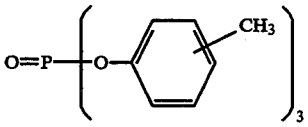
Oil-3
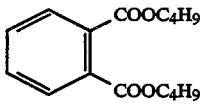

-continued
H-1
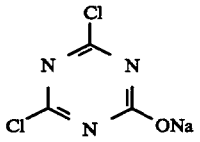
H-2
$(CH_2{=}CHSO_2CH_2)_2O$
SU-1
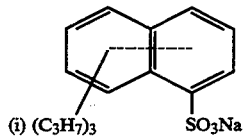
SU-2
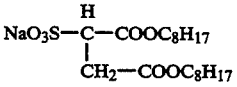
Compound A
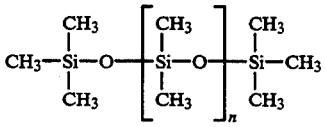
Weight-average molecular weight = 30,000
Compound B
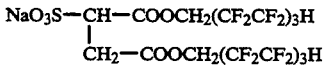
DI-1
(mixture of the following three components)
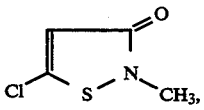
Component A
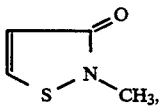
Component B
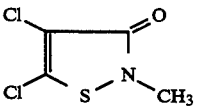
Component C
A:B:C = 50:46:4 (molar ratio)
AI-1
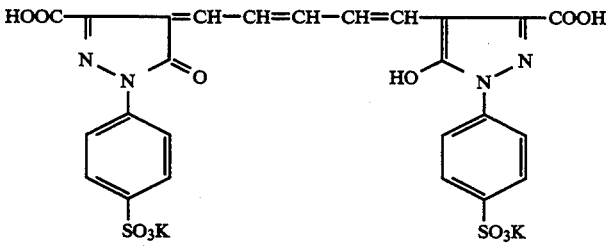
AI-2
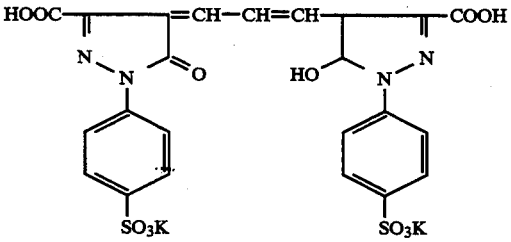
ST-1
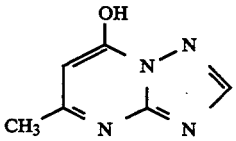
AF-1
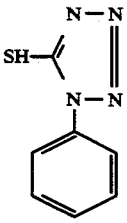
AF-2
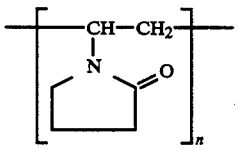
UL-3
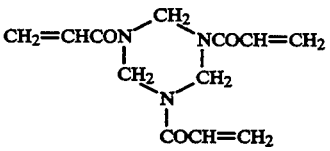
UL-7
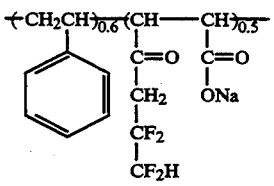

-continued

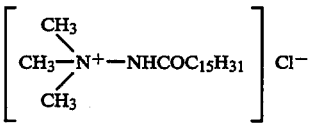

SB-1

$C_8F_{17}S_2NH(CH_2)_3N^+(CH_3)I^-$ SB-2

$C_8F_{17}SO_2N(C_3H_7)CH_2COOK$ SB-3

TABLE 2

| | Characteristics of silver halide light sensitive material | | | | | | |
|---|---|---|---|---|---|---|---|
| | Material of the support | Thickness of support (μm) | Young modulus of elasticity (kg/mm²) | Coefficient of friction in wet state (μk) | Value of left side of formula | Conveying tension (g) | Occurrence of folding |
| Example 1 | Polyethylene terephthalate | 85 | 520 | 0.8 | 3110 | 500 | A |
| Example 2 | Polyethylene naphthalate | 75 | 620 | 0.8 | 3010 | 500 | A |
| Example 3 | Triacetyl cellulose | 85 | 280 | 0.06 | 3074 | 500 | A |
| Example 4 | Polymer polyester | 75 | 420 | 0.06 | 3054 | 500 | A |
| Example 5 | Polyethylene terephthalate | 75 | 520 | 0.06 | 3254 | 500 | A |
| Example 6 | Polyethylene naphthalate | 65 | 620 | 0.06 | 3154 | 500 | A |
| Example 7 | Polyethylene terephthalate | 85 | 520 | 0.8 | 3110 | 650 | A |
| Example 8 | Polyethylene naphthalate | 75 | 620 | 0.8 | 3010 | 650 | A |
| Example 9 | Triacetyl cellulose | 85 | 280 | 0.06 | 3074 | 650 | A |
| Example 10 | Polymer polyester | 75 | 420 | 0.06 | 3054 | 650 | A |
| Example 11 | Polyethylene terephthalate | 75 | 520 | 0.06 | 3254 | 650 | A |
| Example 12 | Polyethylene naphthalate | 65 | 620 | 0.06 | 3154 | 650 | A |
| Example 13 | Polymer polyester | 95 | 420 | 0.8 | 3240 | 650 | A |
| Example 14 | Triacetyl cellulose | 98 | 280 | 0.8 | 3020 | 650 | A |

TABLE 3

| | Characteristics of silver halide light sensitive material | | | | | | |
|---|---|---|---|---|---|---|---|
| | Material of the support | Thickness of support (μm) | Young modulus of elasticity (kg/mm²) | Coefficient of friction in wet state (μk) | Value of left side of formula | Conveying tension (g) | Occurrence of folding |
| Comparative Example 1 | Triacetyl cellulose | 85 | 280 | 0.8 | 2630 | 500 | C |
| Comparative Example 2 | Polymer polyester | 85 | 420 | 0.8 | 2910 | 500 | C |
| Comparative Example 3 | Polyethylene terephthalate | 75 | 520 | 0.8 | 2810 | 500 | C |
| Comparative Example 4 | Polyethylene naphthalate | 65 | 620 | 0.8 | 2710 | 500 | D |
| Comparative Example 5 | Triacetyl cellulose | 75 | 280 | 0.06 | 2774 | 500 | E |
| Comparative Example 6 | Polymer polyester | 65 | 420 | 0.06 | 2754 | 500 | D |
| Comparative Example 7 | Polyethylene terephthalate | 55 | 520 | 0.06 | 2654 | 500 | E |
| Comparative Example 8 | polyethylene naphthalate | 50 | 620 | 0.06 | 2704 | 500 | D |
| Comparative Example 9 | Polymer polyester | 85 | 420 | 0.8 | 2910 | 650 | C |
| Comparative Example 10 | Polyethylene terephthalate | 75 | 520 | 0.8 | 2810 | 650 | C |
| Comparative Example 11 | Polyethylene naphthalate | 65 | 620 | 0.8 | 2710 | 650 | D |
| Comparative Example 12 | Triacetyl cellulose | 75 | 280 | 0.06 | 2774 | 650 | D |

TABLE 3-continued

| | Characteristics of silver halide light sensitive material | | | | | | |
|---|---|---|---|---|---|---|---|
| | Material of the support | Thickness of support (μm) | Young modulus of elasticity (kg/mm²) | Coefficient of friction in wet state (μk) | Value of left side of formula | Conveying tension (g) | Occurrence of folding |
| Comparative Example 13 | Polymer polyester | 65 | 420 | 0.06 | 2754 | 650 | C |
| Comparative Example 14 | Polyethylene terephthalate | 65 | 520 | 0.06 | 2954 | 650 | C |
| Comparative Example 15 | polyethylene naphthalate | 50 | 620 | 0.06 | 2704 | 650 | C |
| Comparative Example 16 | Triacetyl cellulose | 85 | 280 | 0.8 | 2630 | 750 | D |
| Comparative Example 17 | Polymer polyester | 85 | 420 | 0.8 | 2910 | 750 | C |
| Comparative Example 18 | Polyethylene terephthalate | 85 | 520 | 0.8 | 3110 | 750 | D |
| Comparative Example 19 | polyethylene naphthalate | 85 | 620 | 0.8 | 3310 | 750 | D |
| Comparative Example 20 | Triacetyl cellulose | 85 | 280 | 0.06 | 3074 | 750 | D |
| Comparative Example 21 | Polymer polyester | 75 | 420 | 0.06 | 3054 | 750 | D |
| Comparative Example 22 | Polyethylene terephthalate | 75 | 520 | 0.06 | 3254 | 750 | D |
| Comparative Example 23 | polyethylene naphthalate | 65 | 620 | 0.06 | 3154 | 750 | D |

According to the method of the present invention, it is possible to provide a silver halide photographic light-sensitive material processing method capable of continuous efficient processing with good film conveyability, since no folding occurs on sides of the silver halide photographic light-sensitive material during processing using a developing machine. Also, when ,each of the samples obtained in Examples 13 and 14 was cut into 35 mm wide slits for 36 frames and charged in, and drawn out from, the Patrone chamber of Torikkiri Konica Mini (produced by Konica Corporation), slight flaws occurred. On the other hand, no such flaws occurred in any of the samples obtained in Examples 1 through 12.

We claim:

1. A method of processing a silver halide color light-sensitive material having a silver halide emulsion layer on one side of a photographic support of less than 100 μm thickness and a backing layer on the other side of the photographic support, wherein the silver halide color light-sensitive material is processed being conveyed in a processing machine, with a condition that the conveying tension in the processing machine is not more than 700 g, and the following formula applies:

$$(30\times D)+(2\times E)-(600\times \mu k)\geqq 3{,}000$$

wherein D is the thickness (μm) of the photographic support; E is the Young modulus of elasticity (kg/mm²) of the photographic support in a wet state; μk is the coefficient of friction between the backing layer and a conveying roller in the processing machine in a wet state.

2. A method as claimed in claim 1, wherein the thickness of the photographic support is less than 90 μm.

3. A method as claimed in claim 1, wherein the photographic support is a copolymer polyester whose copolymer component is an aromatic dicarboxylic acid having a metal sulfonate group.

4. A method as claimed in claim 3, wherein the copolymer polyester contains an aromatic dicarboxylic acid having a metal sulfonate group and a small amount of diethylene glycol as copolymer components.

5. A method as claimed in claim 4, wherein the glycol is propylene glycol, butanediol, neopentyl glycol, 1,4-cyclohexanedimethanol or p-xylylene glycol.

6. The method as claimed in claim 3 wherein the copolymer polyester contains an aromatic dibasic acid and glycol.

7. A method as claimed in claim 6, wherein the aromatic dibasic acid is terephthalic acid, isophthalic acid or 2,6-naphthalenedicarboxylic acid.

8. A method as claimed in claim 7, wherein the aromatic dibasic acid is terephthalic acid.

9. A method as claimed in claim 3, wherein the aromatic dicarboxylic acid having a metal sulfonate group is 5-sodiumsulfoisophthalic acid, 2-sodiumsulfoisophthalic acid, 4-sodiumsulfoisophthalic acid, or 4-sodiumsulfo-2,6-naphthalenedicarboxylic acid.

10. The method of claim 1, wherein the conveying tension in the processing machine is not less than 250 g.

11. The method of claim 1, wherein the formula applies:

$$3000\leqq(30\times D)+(2\times E)-(600\times \mu k)\leqq 5000.$$

12. The method of claim 1, wherein the formula applies:

$$3000\leqq(30\times D)+(2\times E)-(600\times \mu k)\leqq 4000.$$

13. The method of claim 1, wherein the thickness of the backing layer is 0.1 to 15 μm.

* * * * *